United States Patent [19]

Iden et al.

[11] 4,163,955

[45] Aug. 7, 1979

[54] CYLINDRICAL MODE POWER DIVIDER/COMBINER WITH ISOLATION

[75] Inventors: Floyd W. Iden, Pompton Plains; George P. Scherer, Wayne, both of N.J.

[73] Assignee: International Telephone and Telegraph Corporation, Nutley, N.J.

[21] Appl. No.: 869,725

[22] Filed: Jan. 16, 1978

[51] Int. Cl.[2] ..... H01P 5/12

[52] U.S. Cl. ..... 333/127; 333/238; 333/243

[58] Field of Search ..... 333/6, 9

[56] References Cited

U.S. PATENT DOCUMENTS

| | | | |
|---|---|---|---|
| 3,091,743 | 5/1963 | Wilkinson | 333/9 |
| 3,529,265 | 9/1970 | Podell | 333/9 |
| 4,005,379 | 1/1977 | Lerner | 333/6 |

*Primary Examiner*—Paul L. Gensler

*Attorney, Agent, or Firm*—John T. O'Halloran; Alfred C. Hill

[57] ABSTRACT

The power divider/combiner includes an impedance transformer arrangement coaxial of and within an outer conductor, an input/output coaxial transmission line coupled to the transformer arrangement and the outer conductor and first N-discrete, spaced transmission lines supported by a dielectric cylinder disposed coaxial of and within the outer conductor, each of the first transmission lines being coupled to the transformer means, where N is an integer greater than one. Second N-discrete, spaced transmission lines are disposed coaxial of and transverse to the outer conductor remote from the transformer arrangement, each of the second transmission lines being coupled to a different one of the first transmission lines and terminating in a common metallic disc coaxial of and adjacent the axis of the outer conductor. N-output/input ports are each coupled to a different one of the first transmission lines adjacent the transformer arrangement and N-load ports are each coupled to a different one of the first transmission lines adjacent the second transmission lines.

12 Claims, 6 Drawing Figures

CYLINDRICAL MODE POWER DIVIDER/COMBINER WITH ISOLATION

BACKGROUND OF THE INVENTION

This invention relates generally to an N-way power divider/combiner and more particularly to a power divider/combiner employing non-floating, grounded loads to provide adjacent output/input port isolation for coupling to a plurality of power amplifiers or other active or passive devices.

The best known and most commonly used N-way power divider/combiner was devised by E. J. Wilkinson and is fully described in an article which appeared in the IRE Transactions on Microwave Theory and Techniques, Volume MTT-8, pages 116–118 (Jan., 1960) entitled "An N-Way Hybrid Power Divider". While the Wilkinson device offers matched conditions at all ports, a lower insertion loss, and high isolation between output/input ports, it suffers from the disadvantage that the resistive star required is difficult to realize in practice, particularly for a large number of output/input ports. The resistors used in the resistive star limit the power capability of the divider/combiner due to the difficulty of heat sinking of the resistors.

Ullrich H. Gysel of the Stanford Research Center described a modification of the Wilkinson device in his paper entitled "A New N-Way Power Divider/Combiner Suitable for High Power Applications" which appeared in the Proceedings of the 1975 M.T.T. Symposium, Palo Alto, California. The Gysel modified device offered external isolation loads (high-power load resistors) and monitoring capability for imbalances at the output/input ports. However, Gysel offered no means for practical realization of his apparatus other than stating that its construction would be easy in either stripline, slabline or microstrip.

An attempt to implement the Gysel device resulted in a sandwich type structure employing stripline to provide the required quarter wavelength transmission lines. The design was realized on a 1/32" Teflon board in microstrip form. Two separate boards were used and through connections, necessitated by the topology of the design, were made with 1 mm (millimeter) bolts. This apparatus has marked advantages over its cousin the Wilkinson device in that the isolating means are coupled to ground whereas in the Wilkinson device, the isolating loads are floating with respect to ground. By coupling the loads to ground, fabrication problems and the problem of power limitations as described above is avoided. However, it has been found that this type of a structure is not suitable for an apparatus requiring many ports, for example, 24, due to the complexity of the required transmission line pattern and the resultant increase in insertion loss.

SUMMARY OF THE INVENTION

It is an object of the present invention to provide a multi-port power divider/combiner capable of high power capability and providing a low insertion loss while dividing/combining in a parallel fashion power to or from a large number of power amplifiers or other active or passive devices.

A feature of the present invention is the provision of a cylindrical mode power divider/combiner with isolation comprising: an outer conductor having a longitudinal axis; an impedance transformer means disposed coaxial of the axis and within the outer conductor; an input/output coaxial transmission line coupled to the transformer means and the outer conductor; first N-discrete, spaced transmission lines supported by a first dielectric cylinder disposed coaxial of the axis and within the outer conductor, each of the first transmission lines being coupled to the transformer means, where N is an integer greater than one; second N-discrete, spaced transmission lines disposed coaxial of and transverse to the axis remote from the transformer means, each of the second transmission lines being coupled to a different one of the first transmission lines and terminating in a common metallic disc coaxial of and adjacent the axis; N-output/input ports each coupled to a different one of the first transmission lines adjacent the transformer means; and N-load ports each coupled to a different one of the first transmission lines adjacent the second transmission lines.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
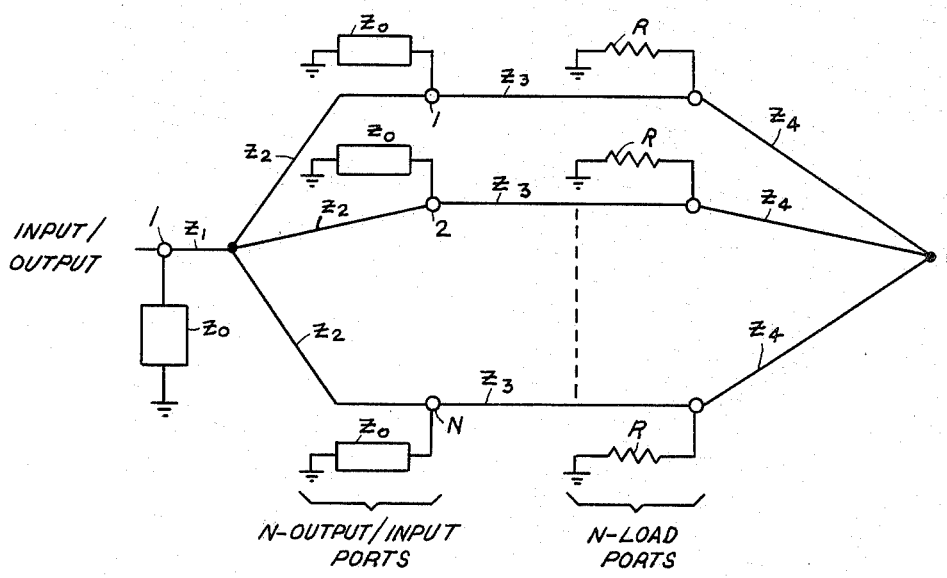
Fig. 1 PRIOR ART
FIG. 1 is an equivalent circuit diagram of the above referred to Gysel power divider/combiner.

FIG. 1 illustrates an equivalent circuit of the above referred to Gysel N-way divider/combiner. A transmission line of characteristic impedance $Z_1$ and N-transmission lines of characteristic impedance $Z_2$ lead from the common input/output port 1 to output ports 1, 2 . . . N. All transmission lines are one quarter wavelength long at the center frequency of the divider/combiner.

In the original Wilkinson divider/combiner, $Z_1=Z_0$, and a resistive star was connected directly between the N-output ports, resulting in a physically complicated arrangement. Gysel replaced the resistive star with a combination of transmission lines and shunt connected resistors having a value R coupled to ground. Transmission lines of characteristic impedance $Z_3$ connect each output port with its associated load port. All of the load ports are coupled by means of transmission lines having a characteristic impedance of $Z_4$ with a common floating star point. Of course, the shunt connected loads having a value R can be replaced by transmission lines of characteristic impedance R of arbitrary length and terminated in a load of value R.

While it is convenient to select $R=Z_0$, other values are possible. Thus, the loads have now become external elements and thus high-power capability can be accomplished. The loads are no longer the power limiting factor of the divider/combiner.

It is from the Gysel arrangement that the applicants' invention proceeds. More specifically, the invention comprises an N-way power divider/combiner employing impedance transformer stages and a practical realization of the Gysel circuit.

Figure 4:
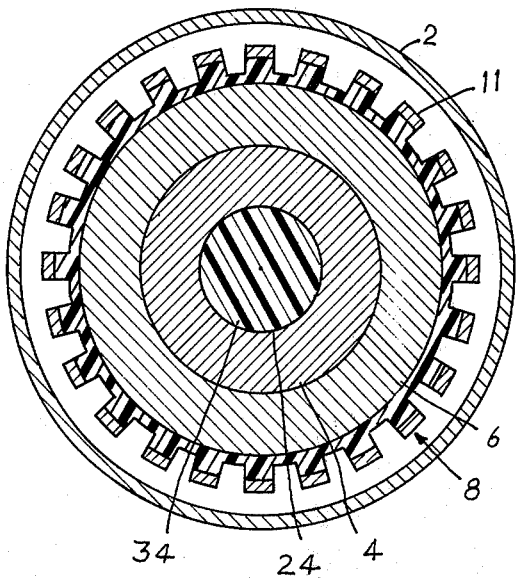
FIG. 4 is a cross-sectional view taken along line 4—4 of FIG. 2.
Figure 3:
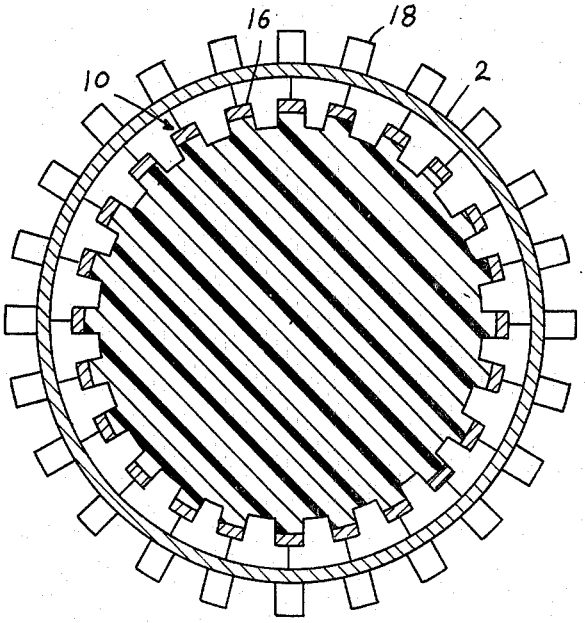
FIG. 3 is a cross-sectional view taken along line 3—3 of FIG. 2.
Figure 2:
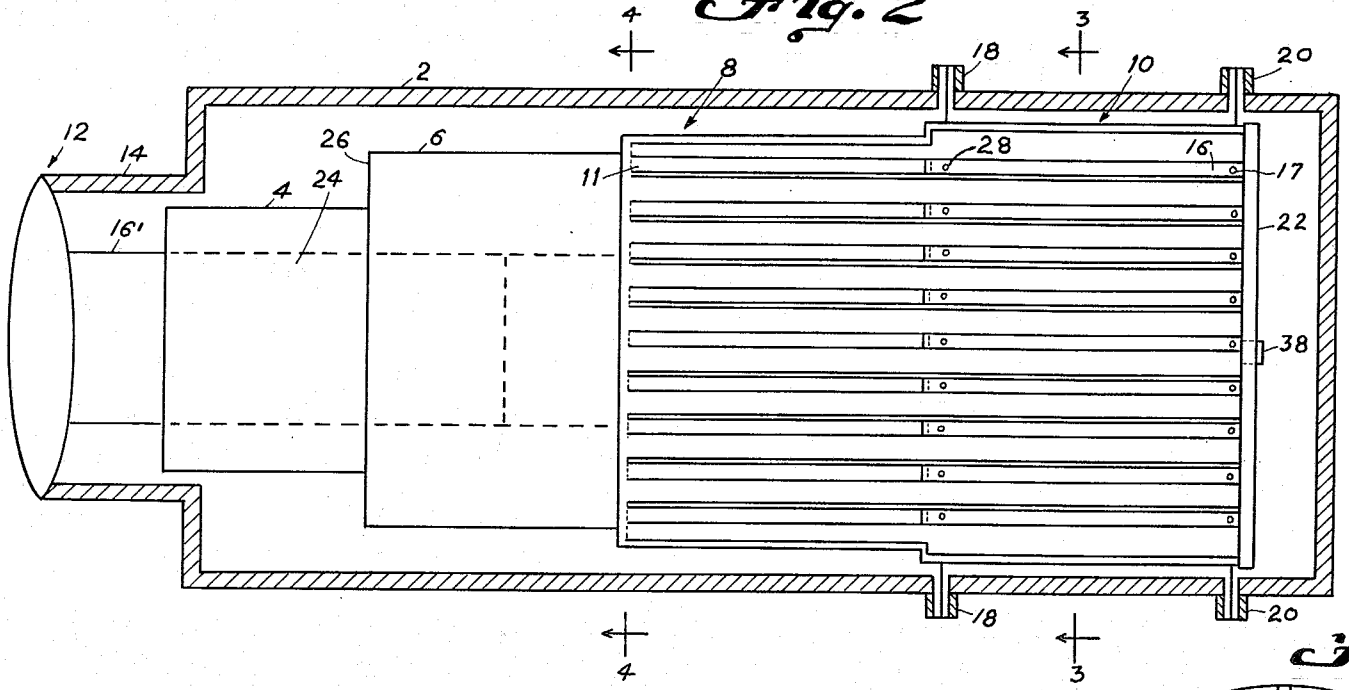
FIG. 2 is a side view with the outer conductor partially removed of the power divider/combiner in accordance with the principles of the present invention.

FIGS. 2, 3 and 4, show an N-way power divider/-combiner in accordance with the present invention. It proceeds from the Gysel circuit, and as such, the invention resides not in the circuit but in the practical realization. Referring to FIGS. 2, 3 and 4, the outer conductor 2 of the inventive power divider/combiner houses impedance transformers 4, 6 and 8 and a plurality of transmission lines 10 and 11. Impedance transformers 4, 6 and 8 comprise the center conductor of the power divider/combiner. A coaxial cable 12 having outer and inner conductors 14 and 16', respectively, can be coupled to the power divider/combiner by means of commercially available coaxial adaptors, for example, those which convert from a type-"N" connector to a 3⅛ inch air dielectric transmission line. N output/input ports 18 are provided for couplings to external loads (power amplifiers or other active or passive devices) and N-load ports 20 are provided for coupling to a plurality of shunt connected loads.

A rear plate 22 coupled the plurality of transmission lines 10 together as will be more fully described herein below.

Still referring to FIGS. 2, 3 and 4, the first stage 4 of the impedance transformer has a hole 24 therethrough for the coupling of the center conductor 16' of a coaxial line (typically 50 ohms). Transformer stage 4 has a length equivalent to a quarter wavelength at the operating frequency of the divider/combiner. For a 50 ohm line, this stage has a cylindrical cross section as shown in FIG. 4, an outer diameter of for example, 1.95 inches and is constructed, for example, of brass. Coupled to impedance transformer stage 4 at junction 26 is a second stage 6 of the impedance transformer having a cylindrical cross section and a length equal to a quarter wavelength at the operating frequency of the divider/combiner. This stage 6 has an outer diameter of approximately 2.5 inches and likewise may be constructed of brass. If a 50 ohm coaxial line is empolyed, and stage 4 has a characteristic impedance of 28.52 ohms, and stage 6 has a characteristic impedance of 10.66 ohms, then the 50 ohms at the input will be converted to 6.98 ohms at the output of stage 6. It is this impedance that corresponds to characteristic impedance $Z_1$ in FIG. 1. The next stage 8 of the inventive N-way divider/combiner comprises a plurality of impedance transformers in the form of strips 11 having a length of a quarter wavelength at the operating frequency of the divider/combiner. These may be constructed of brass and plated with silver and they each have a characteristic impedance of 85.5 ohms. These quarter wavelength impedance transformer strips 11 correspond to the N- transmission lines having impedance $Z_2$ leading from the common input port 1 in FIG. 1 to N output/input ports 1, 2, . . . N.

Contacts for the N-output/input ports are shown at 28 and appear in the last stage of the divider/combiner. This final stage consists of N quarter wavelength transmission lines 16 forming a slotted cylinder. These may likewise be made of brass coated with silver and may have an impedance of 50 ohms each. At a point on each of the transmission lines 16 of the final stage, near the junction of these transmission lines 16 and the transmission lines 11 of stage 8 is located output/input port contacts 28 which may consist of a pinjack. At the other extremity of the transmission lines 16 are a second plurality of pinjacks 17 one at the end of each transmission line 16 which form the contacts for the load ports. The N loads are designated R in FIG. 1. To summarize, in comparing the inventive realization shown in FIGS. 2, 3 and 4 with the Gysel circuit of FIG. 1, impedance transformer stages 4 and 6 correspond to the transmission line of characteristic impedance $Z_1$ in FIG. 1, the plurality of impedance transformer transmission lines 11 in the third stage of FIGS. 2 and 4 correspond to the N-transmission line of characteristic $Z_2$ shown in FIG. 1 terminating in a plurality of output ports 1, 2, . . . N, corresponding to contacts 28 of FIG. 2. Finally, in FIG. 1, there are shown quarter wavelength transmission lines between the plurality of output/input ports and the load ports. These are formed by the quarter wavelength transmission lines 16 in the fourth stage of the divider/-combiner.

Figure 5:
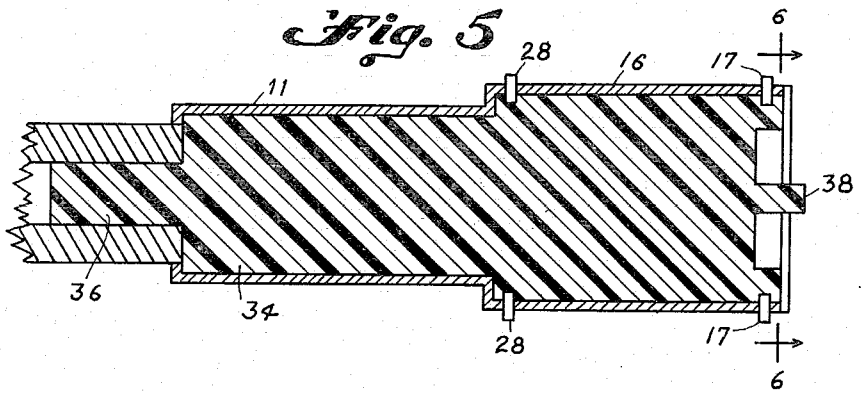
FIG. 5 is a detailed cross-sectional view of the dielectric plug utilized to support the N-transmission lines of the third and fourth portion of the center conductor of FIG. 2.

To provide support for the impedance transformer transmission lines 11 and the quarter wavelength transmission lines 16 in the third and fourth stages, respectively, a dielectric plug, such as Teflon, is provided upon which the transmission lines 11 and 16 are supported as shown in FIG. 5. Teflon plug 34 has a projection 36 which extends into the third stage 6 for providing both support and alignment. As can be seen, strips 11 and 16 rest right on the Teflon plug 34. At the rear extremity of the plug 34, there is a central protuberance 38 the reason for which will be described below.

Figure 6:
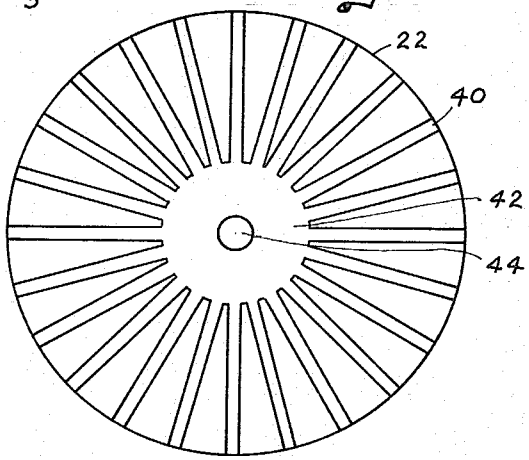
FIG. 6 is a cross-sectional view taken along line 6—6 of FIG. 5.

Thus far, the realization of the Gysel circuit is complete except for the connection of all load ports by means of transmission lines having characteristic impedance $Z_4$ with a common floating starpoint. This is accomplished by means of dielectric plate 22 which is shown in more detail in FIG. 6. The plate 22 shown in FIG. 6 has a plurality of quarter wavelength transmission lines 40 of, for example, copper, extending radially from a common area 42 of copper. The plate has an aperture 44 therethrough. To complete the Gysel circuit, plate 22 is mounted on protuberance 38 in FIG. 5 by aperture 44 such that each of the transmission lines 40 on the plate 22 contact one of the transmission lines 16 in the fourth stage of the power divider/combiner of the present invention.

While we have described above the principles of our invention in connection with specific apparatus it is to be clearly understood that this description is made only by way of example and not as a limitation to the scope of our invention as set forth in the objects thereof and in the accompanying claims.

We claim:

1. A cylindrical mode power divider/combiner with isolation comprising:

an outer conductor having a longitudinal axis;

an impedance transformer means disposed coaxial of said axis and within said outer conductor;

an input/output coaxial transmission line coupled to said transformer means and said outer conductor;

first N-discrete, spaced transmission lines supported by a first dielectric cylinder disposed coaxial of said axis and within said outer conductor, each of said first transmission lines being coupled to said transformer means, where N is an integer greater than one;

second N-discrete, spaced transmission lines disposed coaxial of and transverse to said axis remote from said transformer means, each of said second transmission lines being coupled to a different one of said first transmission lines and terminating in a common metallic disc coaxial of and adjacent said axis;

N-output/input ports each coupled to a different one of said first transmission lines adjacent said transformer means; and N-load ports each coupled to a different one of said first transmission lines adjacent said second transmission lines.

2. A power divider/combiner according to claim 1, wherein said transformer means includes a first hollow cylinder disposed coaxial of said axis coupled to said input/output transmission line, said first cylinder having a first diameter and a length equal to one quarter wavelength at the operating frequency of said divider/combiner, a second hollow cylinder disposed coaxial of said axis coupled to said first cylinder, said second cylinder having a second diameter different than said first diameter and a length equal to one quarter wavelength at the operating frequency of said divider/-combiner, and third N-discrete, spaced transmission lines supported by a second dielectric cylinder coaxial of said axis, said second cylinder having a third diameter different than said second diameter, each of said third transmission lines being coupled between said second cylinder and a different one of said first transmission lines and having a length equal to one quarter wavelength at the operating frequency of said power divider/combiner.

3. A power divider/combiner according to claim 2, wherein said first cylinder has a fourth diameter different than said third diameter.

4. A power divider/combiner according to claim 3, wherein each of said first transmission lines have a length equal to one quarter wavelength at the operating frequency of said power divider/combiner.

5. A power divider/combiner according to claim 4, wherein each of said second transmission lines have a length equal to one quarter wavelength at the operating frequency of said power divider/combiner.

6. A power divider/combiner according to claim 5, wherein said first and second cylinders are formed from a common dielectric plug having a projection extending therefrom to engage the inner surface of said second cylinder and a protuberance extending from said plug to engage the inner surface of a hole formed in said common metallic disc coaxial of said axis.

7. A power divider/combiner according to claim 2, wherein said first and second cylinders are formed from a common Teflon plug having a projection extending therefrom to engage the inner surface of said second cylinder and a protuberance extending from said plug to engage the inner surface of a hole formed in said common metallic disc coaxial of said axis.

8. A power divider/combiner according to claim 7, wherein each of said first transmission lines have a length equal to one quarter wavelength at the operating frequency of said power divider/combiner.

9. A power divider/combiner according to claim 8, wherein each of said second transmission lines have a length equal to one quarter wavelength at the operating frequency of said power divider/combiner.

10. A power divider/combiner according to claim 1, wherein each of said first transmission lines have a length equal to one quarter wavelength at the operating frequency of said power divider/combiner.

11. A power divider/combiner according to claim 10, wherein each of said second transmission lines have a length equal to one quarter wavelength at the operating frequency of said power divider/combiner.

12. A power divider/combiner according to claim 1, wherein each of said second transmission lines have a length equal to one quarter wavelength at the operating frequency of said power divider/combiner.

* * * * *